US010539904B2

(12) United States Patent
Taki et al.

(10) Patent No.: US 10,539,904 B2
(45) Date of Patent: Jan. 21, 2020

(54) OPTICAL SCANNING APPARATUS AND IMAGE FORMING APPARATUS

(71) Applicant: CANON KABUSHIKI KAISHA, Tokyo (JP)

(72) Inventors: Yoshiyuki Taki, Utsunomiya (JP); Noa Sumida, Narashino (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/961,600

(22) Filed: Apr. 24, 2018

(65) Prior Publication Data

US 2018/0348662 A1 Dec. 6, 2018

(30) Foreign Application Priority Data

May 30, 2017 (JP) ..... 2017-107076

(51) Int. Cl.

| | |
|---|---|
| ***B41J 2/435*** | (2006.01) |
| ***B41J 2/37*** | (2006.01) |
| ***G03G 15/04*** | (2006.01) |
| ***G03G 15/043*** | (2006.01) |
| ***B41J 2/47*** | (2006.01) |

(52) U.S. Cl.
CPC ..... *G03G 15/04072* (2013.01); *B41J 2/471* (2013.01); *G03G 15/043* (2013.01)

(58) Field of Classification Search
CPC .. B41J 2/471; G03G 15/04072; G03G 15/043
See application file for complete search history.

(56) References Cited

U.S. PATENT DOCUMENTS 5,812,181 A * 9/1998 Ishibe ..... G02B 13/0005 347/258
2015/0035930 A1 2/2015 Ishihara et al.

FOREIGN PATENT DOCUMENTS

| | | | |
|---|---|---|---|
| JP | H01-302217 | A | 12/1989 |
| JP | 2008-310257 | A | 12/2008 |
| JP | 2015-031824 | A | 2/2015 |

* cited by examiner

*Primary Examiner* — Julian D Huffman
(74) *Attorney, Agent, or Firm* — Canon U.S.A., Inc., IP Division

(57) ABSTRACT

An optical scanning apparatus includes a deflector configured to deflect a light beam from a light source and scan a surface to be scanned in a main-scanning direction and a single imaging optical element configured to guide the light beam deflected by the deflector to the surface to be scanned. Scanning speeds of the light beam on the surface to be scanned at an on-axis image height and at an off-axis image height are different from each other, and conditions $$0.0<(R1_{\pm h/2}+R2_{\pm h/2})/(R1_{\pm h/2}-R2_{\pm h/2})<1.7 \text{ and}$$

$$0.8<h/TC<2.0$$

are satisfied.

10 Claims, 5 Drawing Sheets

OPTICAL SCANNING APPARATUS AND IMAGE FORMING APPARATUS

BACKGROUND

Field of Disclosure

The present disclosure relates to an optical scanning apparatus, suitably used in an image forming apparatus such as a laser beam printer (LBP), a digital copier, or a multi-function printer.

Description of Related Art

In the related art, an imaging optical system that is constituted by a single imaging optical element and that serves as an optical scanning apparatus used for an image forming apparatus is known. In the imaging optical system, a light beam is deflected by a deflector and guided to a surface to be scanned. U.S. Patent Application Publication No. 2015/0035930 discloses a light scanning apparatus configured to scan a surface to be scanned at a nonuniform speed with a light beam passing through a single imaging optical element. In this configuration, the imaging optical element can be disposed near a deflector, and the size of the entire apparatus can be reduced.

U.S. Patent Application Publication No. 2015/0035930 does not take into sufficient consideration the effect that the spot shape formed by the imaging optical element on the surface to be scanned exerts on the printing performance of the light scanning apparatus. In particular, a minuscule intensity peak (side lobe) that appears outside the spot because of coma may prevent the light scanning apparatus from achieving good printing performance.

SUMMARY

An optical scanning apparatus according to an aspect of the present disclosure includes a deflector configured to deflect a light beam from a light source and scan a surface to be scanned in a main-scanning direction and a single imaging optical element configured to guide the light beam deflected by the deflector to the surface to be scanned. Scanning speeds of the light beam on the surface to be scanned at an on-axis image height and at an off-axis image height are different from each other, and conditions $$0.0<(R1_{\pm h/2}+R2_{\pm h/2})/(R1_{\pm h/2}-R2_{\pm h/2})<1.7 \text{ and}$$

$$0.8<h/TC<2.0$$

are satisfied, where a maximum off-axis image height in the main-scanning direction on the surface to be scanned is represented as Y=±h, a radius of curvature of an entrance surface and a radius of curvature of an exit surface of the imaging optical element in a main-scanning cross section at a position where a principal ray reaching an image height Y=±h/2 passes are denoted, by $R1_{\pm h/2}$ and $R2_{\pm h/2}$, respectively, and a distance from the deflector to the surface to be scanned on an optical axis of the imaging optical element is denoted by TC.

Further features of the present disclosure will become apparent from the following description of exemplary embodiments with reference to the attached drawings.

DESCRIPTION OF THE EMBODIMENTS

Figure 1:
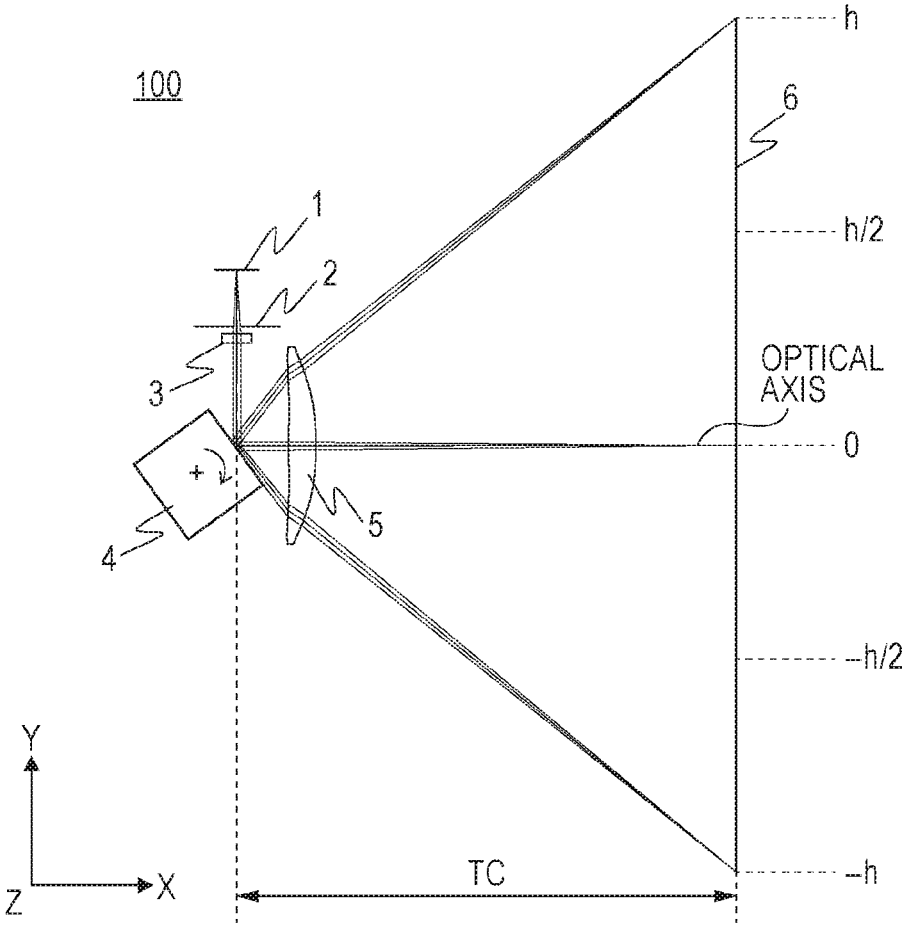
FIG. 1 is a schematic diagram of principal portions of an optical scanning apparatus according to an embodiment.

Hereinafter, an exemplary embodiment of the present disclosure will be described, with reference to the drawings. For convenience, the drawings are not necessarily drawn to scale. The same members in the drawings are denoted by the same reference numerals, and duplicate description thereof will be omitted.

In the following description, the term "main-scanning direction" denotes a direction perpendicular to a rotational axis (or swing axis) of a deflector and to a direction of the optical axis of an imaging optical system, the main-scanning direction being a direction in which a by the deflector, and the term "sub-scanning direction" denotes a direction parallel to the rotational axis (or swing axis) of the deflector. The term "main-scanning cross section" denotes a cross section that includes the optical axis of the imaging optical system and is parallel to the main-scanning direction, the main-scanning cross section being perpendicular to the sub-scanning direction, and the term "sub-scanning cross section" denotes a cross-section that is parallel to the optical axis of the imaging optical system and the sub-scanning direction, the sub-scanning cross section being perpendicular to the main scanning direction.

FIG. 1 is a schematic diagram viewed in the main-scanning cross section (XY cross section) of principal portions of an optical scanning apparatus 100 according to an embodiment of the present disclosure. The optical scanning apparatus 100 according to this embodiment includes a deflector 4 and a single imaging optical element 5. The deflector 4 deflects a light beam from a light source 1 and scans a surface to be scanned 6 in the main-scanning direction (Y-axis direction in FIG. 1). The imaging optical element 5 guides the light beam deflected by the deflector 4 to the surface to be scanned 6. The imaging optical system constituted by the single imaging optical element 5 enables size reduction and cost reduction of the optical scanning apparatus 100. Further, the imaging optical element 5 according to this embodiment is configured so that the light beam passing through the imaging optical element 5 scans the surface to be scanned 6 at a nonuniform speed. This configuration will be described in detail.

In general, an imaging optical system in an optical scanning apparatus has distortion (fθ characteristics) that provides a substantially proportional relation between a rotation angle (scanning angle) of a deflector and an image height in the main-scanning direction on a surface to be scanned so that a light beam passing through the imaging optical system scans the surface to be scanned at a constant speed. In addition, the imaging optical system needs to correct for field curvature appropriately in the entire effective area so as to form a good image (spot) in the effective area (printing area) on the surface to be scanned.

However, if the imaging optical system is constituted by a single imaging optical element, shapes of optical surfaces of the imaging optical element need to be changed considerably at the on-axis image height and at off-axis image heights to ensure scanning at a constant speed while obtaining good correction for field curvature. If the imaging optical element is disposed closer to the deflector to achieve further size reduction of the optical scanning apparatus, more sharp changes in the shapes of the optical surfaces are needed, which leads to an increase in coma.

Thus, the imaging optical element 5 according to this embodiment is designed so that a light beam passing through the imaging optical element 5 does not scan the surface to be scanned 6 at a constant speed (i.e., scans the surface to be scanned 6 at a nonuniform speed). More specifically, the scanning speeds of the light beam at the on-axis image height and at the off-axis image heights are different in the optical scanning apparatus 100 according to this embodiment. Using different scanning speeds of the light beam at the on-axis image height and at the off-axis image heights enables the imaging optical element 5 to be disposed closer to the deflector 4, leading to further size reduction of the entire apparatus.

If positions or shapes of various optical components deviate from designed positions or shapes because of manufacturing errors or the like, good printing performance may not be obtained because of a change in the spot shape caused by coma generated at around an intermediate image height in the effective area.

Figure 2A:
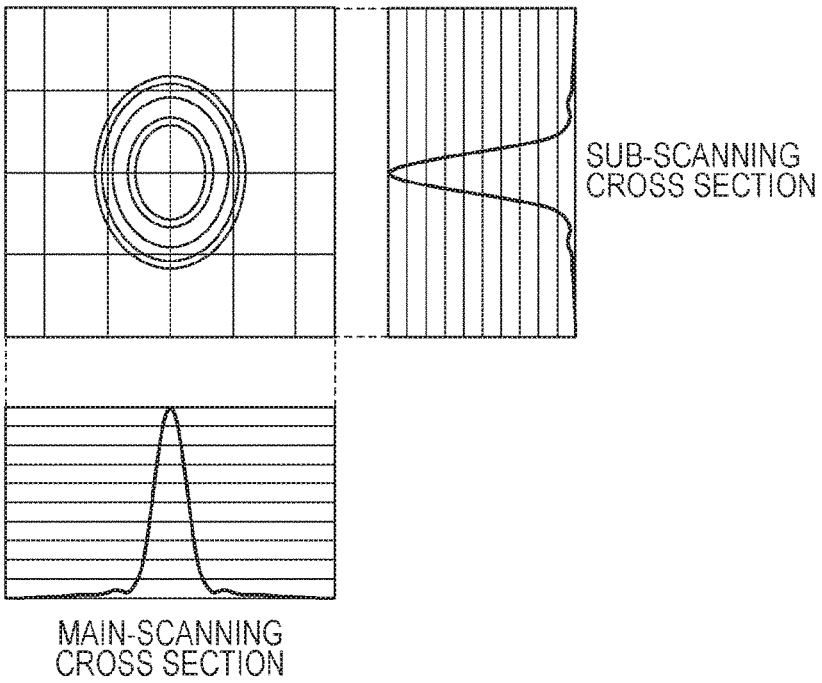
FIGS. 2A and 2B illustrate an effect of coma on a spot shape.
Figure 2B:
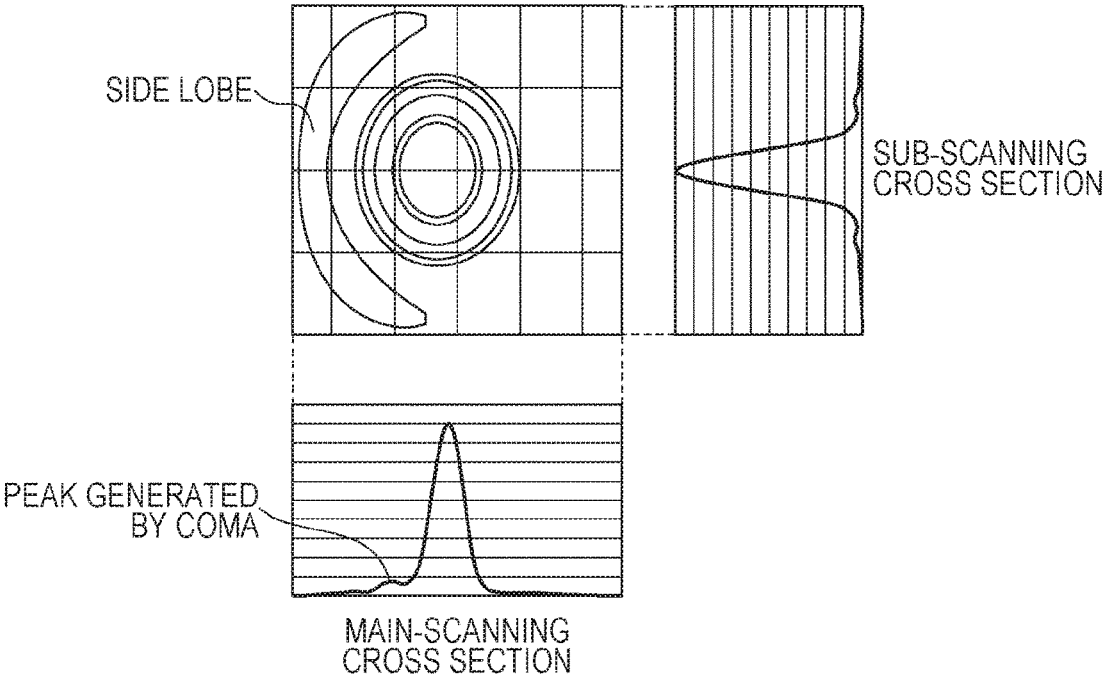

FIGS. 2A and 2B illustrate shapes of spots formed by a typical optical scanning apparatus on a surface to be scanned and distributions of an amount of light of the spots in the main-scanning cross section and in the sub-scanning cross section. FIG. 2A illustrates a spot obtained when coma of the imaging optical system is corrected for appropriately, and FIG. 2B illustrates a spot deformed by coma generated at around an intermediate image height. In contrast to the spot illustrated in FIG. 2A, which is good, a side lobe appears in the spot illustrated in FIG. 2B.

If such an intensity peak caused by coma increases because of manufacturing errors or the like, scanning by an optical scanning apparatus of a surface to be scanned becomes nonuniform, and density nonuniformity may appear in an image formed by an image forming apparatus. Thus, reducing coma to be generated at around an intermediate image height by taking into consideration manufacturing errors of various optical components is needed for an optical scanning apparatus to simultaneously achieve size reduction and improve printing performance.

Figure 3A:
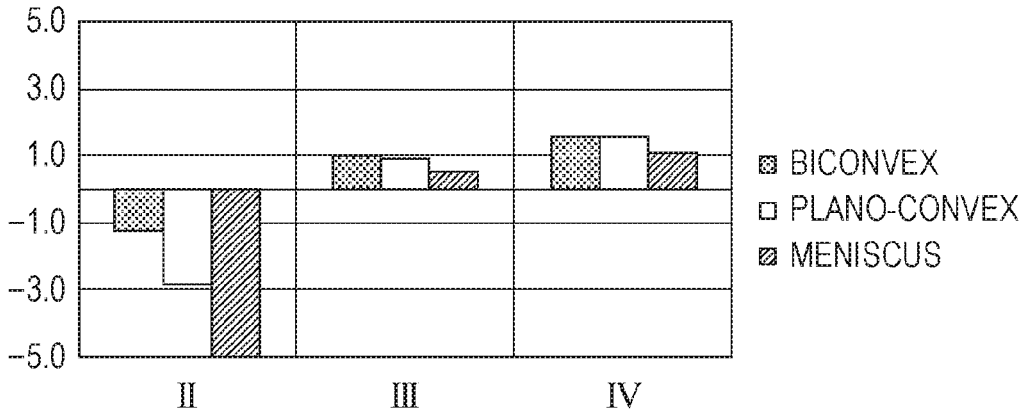
FIGS. 3A and 3B illustrate a relation between lens shape and aberration coefficients.
Figure 3B:
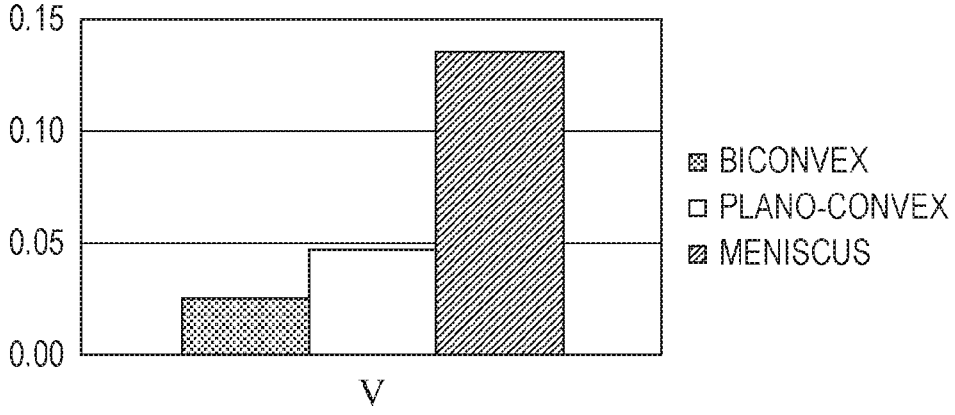

FIGS. 3A and 3B illustrate values of aberration coefficients for biconvex, plano-convex, and meniscus lenses having the same focal lengths. FIGS. 3A and 3B illustrate the aberration coefficient II corresponding to coma, the aberration coefficient III corresponding to field curvature, the aberration coefficient V corresponding to distortion, and the aberration coefficient IV, which is a sum of the aberration coefficient III and the aberration coefficient V.

As illustrated in FIGS. 3A and 3B, it is understood that good correction for field curvature can be obtained by selecting a meniscus lens, which has small aberration coefficients III and IV. On the other hand, it is understood that good correction for coma and distortion can be obtained by selecting a biconvex lens, which has small aberration coefficients II and V. It is also understood that a plano-convex lens has an intermediate performance between a meniscus lens and a biconvex lens.

For an optical scanning apparatus that scans a surface to be scanned at a nonuniform speed, a certain amount of distortion of the imaging optical element is allowable. Thus, in this embodiment, considering the balance of various aberrations, the shape of the imaging optical element 5 is determined to be substantially plano-convex at a position where a light beam reaching the vicinity of an intermediate image height passes. By adopting a shape close to a plano-convex shape, good printing performance can be maintained even if manufacturing errors occur because coma at around intermediate image heights is reduced while correcting for field curvature. The shape of the imaging optical element 5 according to this embodiment will be described in detail.

If a focusing position (image height) of a light beam deflected by the deflector 4 on the surface to be scanned 6 in the main-scanning direction is Y [mm], the on-axis image height is represented as Y=0, and an off-axis image height is represented as Y≠0. If the maximum off-axis image height is assumed to be Y=±h, the effective area in the surface to be scanned 6 is represented as −h≤Y≤h. It is assumed that the radius of curvature of the entrance surface and the radius of curvature of the exit surface of the imaging optical element 5 in the main-scanning cross section at a position where the principal ray reaching the image height Y=±h/2 (intermediate image height) are $R1_{\pm h/2}$ [mm] and $R2_{\pm h/2}$ [mm], respectively, and the distance from the deflector 4 to the surface to be scanned 6 is TC [mm].

The optical scanning apparatus 100 according to this embodiment satisfies the following Expressions (1) and (2).

$$0.0<(R1_{\pm/h}+R2_{\pm h/2})/(R1_{\pm h/2}-R2_{\pm h/2})<1.7 \quad (1)$$

$$0.8<h/TC<2.0 \quad (2)$$

Expression (1) represents the shape of the imaging optical element 5 at a position corresponding to the intermediate image height. By satisfying Expression (1), generation of aberrations at the intermediate image height can be suppressed. As the middle term of Expression (1) increases, the shape of the imaging optical element 5 at the position corresponding to the intermediate image height becomes closer to a meniscus shape, and suppressing the generation of coma is difficult if the middle term of Expression (1) exceeds the upper limit of Expression (1). On the other hand, as the middle term of Expression (1) decreases, the shape of the imaging optical element 5 at a position corresponding to the intermediate image height becomes closer to a biconvex shape, and suppressing the generation of field curvature is difficult if the middle term of Expression (1) becomes lower than the lower limit of Expression (1).

Expression (2) represents a relation between a distance from the deflector 4 to the surface to be scanned 6 and the length of the printing area. If the distance TC becomes so short that the middle term of Expression (2) exceeds the upper limit of Expression (2), the scanning field angle becomes too large, and the imaging optical element 5 needs to be enlarged in the main-scanning direction. In addition, the refractive power of the imaging optical element 5 in the main-scanning cross section needs to be increased, and corrections for various aberrations become difficult. On the other hand, if the distance TC becomes so long that the middle term of Expression (2) becomes smaller than the lower limit of Expression (2), size reduction of the entire apparatus becomes difficult.

Thus, the optical scanning apparatus 100 according to this embodiment includes the imaging optical system that is constituted by the single imaging optical element 5 and that is configured to scan the surface to be scanned 6 at a nonuniform speed. The optical scanning apparatus 100 is designed to satisfy Expressions (1) and (2) and thus achieves size reduction and printing performance simultaneously. Further, it is more desirable that the following Expressions (1') and (2') be satisfied.

$$1.0<(R1_{\pm h/2}+R2_{\pm h/2})/(R1_{\pm h/2}-R2_{\pm h/2})<1.7 \quad (1')$$

$$0.8<h/TC<1.0 \quad (2')$$

Next, scanning characteristics of the imaging optical element 5 according to this embodiment will be described. If a scanning angle of the deflector 4 is denoted by θ [deg] and an imaging coefficient at the on-axis imaging: height is denoted by K [mm], the scanning characteristics of the imaging optical element 5 are represented by the following Expression (3).

$$Y=(K/B)\times\tan(B\times\theta) \quad (3)$$

The imaging coefficient K corresponds to f in fθ characteristics, which are scanning characteristics Y=f×θ when a parallel beam is incident on the imaging optical element 5, and serves as a coefficient to extend the fθ characteristics into light beams other than a parallel beam, such as a convergent beam and a divergent beam. In other words, the imaging coefficient K is a coefficient to establish a proportional relation between the image height Y and the scanning angle θ irrespective of the degree of convergence of the light beam incident on the imaging optical element 5.

The coefficient B in Expression (3) is a coefficient to determine the scanning characteristics of the imaging optical element 5 (scanning characteristics coefficient). When B=0, Expression (3) becomes Y=K×θ and corresponds to the fθ characteristics. When B≠0, Expression (3) provides scanning characteristics in which the image height Y and the scanning speed θ are not proportional. For example, when B=1, Expression (3) becomes Y=K tan θ, which corresponds to projection characteristics Y=f tan θ of an optical system used in an imaging apparatus such as a camera. In other words, by setting the scanning characteristics coefficient B in Expression (3) to the range of 0<B<1, scanning characteristics between the projection characteristics Y=f tan θ and the fθ characteristics Y=fθ can be obtained.

Differentiating Expression (3) with respect to the scanning angle θ yields the scanning speed of the light beam on the surface to be scanned 6 with regard to the scanning angle θ, as in the following Expression (4).

$$dY/d\theta=K/\cos^2(B\times\theta) \quad (4)$$

Further, dividing Expression (4) by the speed at the on-axis image height, which is represented as dY(0)/dθ=K, yields the following Expression (5).

$$(dY/d\theta)/K=1/\cos^2(B\times\theta) \quad (5)$$

Expression (5) represents an amount of deviation in a speed at an off-axis image height from a speed at the on-axis image height, which represents an amount of deviation in partial magnification at an off-axis image height from a partial magnification at the on-axis image height (deviation in partial magnification). The optical scanning apparatus 100 according to this embodiment has a partial magnification, and thus the scanning speed of the light beam is not the same at the on-axis image height as at an off-axis image height when B≠0. In other words, because a scanning position at an off-axis image height (scanning distance per unit time) is extended in accordance with the deviation in partial magnification, scanning the surface to be scanned 6 without taking into account the deviation in partial magnification will result in degradation in quality of an image formed on the surface to be scanned 6 (degradation in printing performance).

Accordingly, in this embodiment, a controller (e.g., a printer controller) controls light emission from the light source 1 and reduces degradation in printing performance. Specifically, controlling modulation timing (emission timing) and a modulation period (emission period) of the light source 1 in accordance with the deviation in partial magnification enables electrical correction for the scanning position and the scanning time on the surface to be scanned 6. Thus, the deviation in partial magnification and the degradation in quality of an image can be corrected for, and good printing performance is achieved as in the case where the fθ characteristics are satisfied. When the controller controls the light source 1, the deviation in partial magnification of the imaging optical element 5 is desirably less than or equal to 2% at all of the image heights to obtain good printing performance.

The optical scanning apparatus 100 according to this embodiment desirably satisfies the following Expression (6) at the maximum off-axis image height, which is represented as Y=±h.

$$0.3\leq B\leq 0.6 \quad (6)$$

If B is smaller than the lower limit of Expression (6), the deviation in partial magnification is so small that balancing the printing performance and the optical performance of the entire apparatus is difficult. If B is larger than the upper limit of Expression (6), the deviation in partial magnification is so large that correcting for the scanning position and the scanning period is difficult.

Further, if the focal length on the optical axis in the main-scanning cross section of the imaging optical element 5 is denoted by f, and a lateral magnification (parazial lateral magnification) in the sub-scanning cross section of the imaging optical element 5 is denoted by $\beta_s$, which is called a sub-scanning magnification, at least one of the following Expressions (7) and (8) is desirably $$1.0\leq TC/f\leq 1.3 \quad (7)$$

$$3.0<|\beta_s|<6.0 \quad (8)$$

If the focal length is so snort that the middle term of Expression (7) is larger than the upper limit of Expression (7), the refractive power of the imaging optical element 5 needs to be larger, and maintaining good optical performance is difficult. If the focal length is so long that the middle term of Expression (7) is lower than the lower limit of Expression (7), the imaging optical element 5 needs to be enlarged in the main-scanning direction, and size reduction of the entire apparatus is difficult.

If the sub-scanning magnification is so large that the middle term of Expression (8) is larger than the upper limit of Expression (8), an amount of deviation in a printing position due to placement errors of various optical members becomes large. If the sub-scanning magnification is so small that the middle term of Expression (8) is smaller than the lower limit of Expression (8), the imaging optical element 5 needs to be enlarged in the main-scanning direction, and size reduction of the entire apparatus is difficult.

Further, it is more desirable that the following Expressions (7') and (8') be satisfied.

$$1.0\leq TC/f\leq 1.1 \quad (7')$$

$$4.5\leq|\beta_s|<6.0 \quad (8')$$

It is desirable that the imaging optical element 5 be biconvex at the on-axis image height. The imaging optical element 5 being biconvex enables the principal point of the imaging optical element 5 on the image side to be closer to the image, and an increase in main scanning magnification of the imaging optical element 5 can be suppressed if size reduction of the entire apparatus is attempted by placing the imaging optical element 5 closer to the deflector 4.

As described above, in the optical scanning apparatus 100 according to this embodiment, the imaging optical system is constituted by the single imaging optical element 5 and configured to scan the surface to be scanned 6 at a nonuniform speed. In this configuration, appropriately setting the shape of the imaging optical element 5 and the position of the deflector 4 enables size reduction and printing performance simultaneously.

EXAMPLE

Hereinafter, an optical scanning apparatus 100 according to an example of the present disclosure will be described. The optical scanning apparatus 100 according to this example has a configuration similar to the optical scanning apparatus 100 according to the embodiment described above, and duplicate descriptions will be omitted. The optical scanning apparatus 100 according to this example includes an aperture stop 2, an incidence optical system 3, and the deflector 4 and the imaging optical system, both of which are described above. The aperture stop 2 restricts a light beam from the light source 1, and the incidence optical system 3 guides the light beam to a deflecting surface of the deflector 4.

In the optical scanning apparatus 100, the light beam emitted from the light source 1 is formed into an elliptical shape by the aperture stop 2 having an opening of an elliptical shape and guided to the deflecting surface of the deflector 4 by the incidence optical system 3. For example, a semiconductor laser may be used as the light source 1, and may nave a single light emitting point or a plurality of light emitting points. In this example, although an elliptical aperture stop having an opening of an elliptical shape is used as the aperture stop 2, the shape of the opening is not limited to an ellipse, and, for example, a rectangular aperture stop having an opening of a rectangular shape may be used.

The incidence optical system 3 according to this example includes a single incidence optical element (incidence lens) whose powers are different in the main-scanning cross section and in the sub-scanning cross section. The incidence optical element is an anamorphic collimator lens that forms a line image elongated in the main-scanning direction by converting the light beam into a substantially parallel light beam in the main-scanning cross section and condensing the light beam at the deflecting surface of the deflector 4 or the vicinity thereof in the sub-scanning cross section. The substantially parallel light beam includes not only a strictly parallel light beam but also a weakly convergent light beam and a weakly divergent light beam.

The incidence optical system 3 according to this example is a plastic mold lens made of a resin material, and a large cost reduction is possible in comparison with a case of using a glass lens. Further, because the incidence optical system 3 has a diffractive surface, compensation is possible for variations in the focal condition caused by a change in the emission wavelength of the light source 1 or a change in the shape of each optical plane, both of which occur when the environmental temperature changes. For example, when the environmental temperature becomes higher than a room temperature, the wavelength of the light beam becomes longer, and the resin material is lengthened. This leads to an increased power of the diffractive surface while the power of a refractive surface (refractive power) decreases. Consequently, a change in the focal condition due to the refractive surface can cancel out a change in the focal condition due to the diffractive surface.

The deflector 4 is rotated at a constant speed in the arrow direction in FIG. 1 by a driving unit (not depicted) such as a motor. The light beam from the incidence optical system 3 is deflected on the deflecting surface and scans the effective area of the surface to be scanned 6 in the main-scanning direction via the imaging optical system. Although a rotating multiple-facet mirror (polygon mirror) having four deflecting surfaces serves as the deflector 4 in this example, the number of deflecting surfaces is not limited to four. A swing mirror having one or two deflecting surfaces swinging around a swing axis may be used instead of the rotating multiple-facet mirror.

The imaging optical system according to this example includes a single imaging optical element (toric lens) whose powers are different in the main-scanning cross section and in the sub-scanning cross section. The imaging optical system guides the light beam deflected on the deflecting surface to the surface to be scanned 6 and condenses the light beam on the surface to be scanned 6. An image of the light source 1 is formed by the imaging optical system on the surface to be scanned 6 or in the vicinity thereof in both of the main-scanning cross section and the sub-scanning cross section. In the imaging optical system, because the deflection surface or the vicinity thereof are conjugate with the surface to be scanned 6 or the vicinity thereof in the sub-scanning cross section, deviation in the scanning position on the surface to be scanned 6 caused by the deflecting surface being tilted is reduced (optical face tangle error compensation).

The incidence optical system 3 and the imaging optical system according to this example use plastic molded lenses formed by injection molding as a non-limiting example, and glass lenses may be used instead. However, using plastic molded lenses is desirable in view of improving productivity and optical performance because plastic molded lenses are easy to form a diffractive surface and an aspherical shape and suitable for mass production. Further, the incidence optical system 3 may optionally be constituted by a collimator lens that converts the light beam to a substantially parallel light beam in the main-scanning cross section and a cylindrical lens that condenses the light beam in the sub-scanning cross section. However, the incidence optical system 3 is desirably constituted by a single optical element as in this example for size and cost reduction of the entire apparatus.

A configuration of the optical scanning apparatus 100 according to this example is illustrated in Table 1, and parameters of a shape of an imaging optical element 5 according to this example are provided in Table 2. An on-axis deflecting point in Table 1 denotes a point where the deflecting surface intersects with the principal ray of a light beam (on-axis light beam) that is emitted from the light source 1 and incident on the surface to be scanned 6 at the on-axis image height. Each of the distances indicates a value on the optical axis of the imaging optical element 5. An angle of the incident principal ray indicates an angle that the optical axis of the imaging optical element 5 forms with the principal ray of a light beam that is exiting the incidence optical system 3 and that is incident on the deflecting surface.

A main-scanning magnification and a sub-scanning magnification indicate lateral magnifications in the main-scanning cross section and in the sub-scanning cross section, respectively. Center coordinates of rotation of the deflector 4 are represented with respect to an origin where the deflecting surface intersects with the principal ray of the on-axis light beam. The rotation angle and the maximum scanning field angle of the deflector 4 are represented with respect to the optical axis of the imaging optical element 5 and are symmetrical about the optical axis of the imaging optical element 5, and values on one side are indicated. A radius of curvature and aspherical surface coefficients of each optical surface in Table 2 are indicated separately for the side of the light source 1 with respect to the optical axis (positive side in the Y axis, denoted by Upper) and for the side opposite to the light source 1 with respect to the optical axis (negative side in the Y axis, denoted by Lower). "E±N" in Table 2 represents "$\times 10^{\pm N}$".

TABLE 1

| | |
|---|---|
| Wavelength of light emitted from light source λ [nm] | 790 |
| Number of deflecting surfaces | 4 |
| Rotation angle of deflector for effective area [±deg] | 25.5 |
| Diameter of circumcircle of deflector in main-scanning cross section φ [mm] | 20 |
| Length of effective area h [mm] | ±105 |
| Distance from on-axis deflecting point to surface to be scanned TC [mm] | 125 |
| Distance from on-axis deflecting point to entrance surface of imaging optical element T1 [mm] | 13.8 |
| Thickness of imaging optical element on optical axis d [mm] | 6 |
| Distance from on-axis deflecting point to exit surface of imaging optical element T2 [mm] | 19.8 |
| Distance from exit surface of imaging optical element to surface to be scanned Sk [mm] | 105.2 |
| Center coordinate of rotation of deflector X | −5.89 |
| Center coordinate of rotation of deflector Y | −4.11 |
| Angle of incident principal ray in main-scanning cross section [deg] | 90 |
| Angle of incident principal ray in sub-scanning cross section [deg] | 0 |
| Imaging coefficient on optical axis K | 109.68 |
| Scanning characteristics coefficient at maximum off-axis image height B [mm] | 0.571 |
| Maximum scanning field angle $\theta_{max}$ [±deg] | 51 |
| Radius of curvature $R1_{+h/2}$ [mm] of entrance surface of imaging optical element at image height +h/2 | −520 |
| Radius of curvature $R2_{+h/2}$ [mm] of exit surface of imaging optical element at image height +h/2 | −65.34 |
| Radius of curvature $R1_{-h/2}$ [mm] of entrance surface of imaging optical element at image height −h/2 | −665.68 |
| Radius of curvature $R2_{-h/2}$ [mm] of exit surface of imaging optical element at image height −h/2 | −68.29 |

TABLE 2

| Shape of imaging optical element | | | | |
|---|---|---|---|---|
| | Entrance surface (First surface) | | Exit surface (Second surface | |
| | Upper | Lower | Upper | Lower |
| R | 9.742E+01 | | −1.747E+02 | |
| k | −1.124E+01 | | 3.983E+01 | |
| B4 | 2.314E−05 | −2.263E−05 | −1.042E−05 | −8.869E−06 |
| B6 | 4.651E−08 | 4.337E−08 | 6.612E−10 | −1.144E−09 |
| B8 | −4.631E−11 | −3.769E−11 | 2.237E−11 | 2.003E−11 |
| B10 | 1.534E−14 | 1.113E−14 | −1.993E−14 | −1.216E−14 |
| B12 | 0.000E+00 | 0.000E+00 | 0.000E+00 | 0.000E+00 |
| r | −2.398E+01 | | −6.836E+00 | |
| E2 | −4.071E−06 | −4.954E−07 | 1.597E−04 | 0.642E−04 |
| E4 | 1.516E−07 | 1.601E−07 | −6.833E−07 | −5.409E−07 |
| E6 | −3.842E−10 | −3.462E−10 | 1.243E−09 | 1.236E−09 |
| E8 | −1.312E−14 | 2.374E−14 | −1.655E−12 | −6.531E−13 |
| E10 | 0.000E+00 | 0.000E+00 | 1.111E−18 | 1.111E−18 |
| E12 | 0.000E+00 | 0.000E+00 | 0.000E+00 | 0.000E+00 |
| E14 | 6.469E−24 | 0.000E+00 | 0.000E+00 | 0.000E+00 |
| E16 | −9.801E−24 | 0.000E+00 | 1.469E−24 | 0.000E+00 |

TABLE 2-continued

| Shape of imaging optical element | | | | |
|---|---|---|---|---|
| | Entrance surface (First surface) | | Exit surface (Second surface | |
| | Upper | Lower | Upper | Lower |
| E1 | −1.351E−03 | | −7.415E−04 | |
| E3 | 1.507E−06 | | −9.466E−08 | |
| E5 | 5.119E−10 | | 3.895E−09 | |
| E7 | 1.275E−12 | | 4.077E−12 | |
| E9 | 0.000E+00 | | 1.148E−14 | |

A shape in the main-scanning cross section of each optical surface (lens surface) of the imaging optical element 5 according to this example is defined as a shape of the line of intersection of each optical surface and the main-scanning cross section, the line of intersection passing through the surface vertex of the optical surface, and the shape is represented by the following Expression.

$$X = \frac{Y^2/R}{1+(1-(1+k)(Y/R)^2)^{1/2}} + B_2Y^2 + B_4Y^4 + B_6Y^6 + B_8Y^8 + B_{10}Y^{10} + B_{12}Y^{12} + B_{14}Y^{14} + B_{16}Y^{16}$$

Here, a local coordinate system is defined, in which the origin is set to a point of intersection of each optical surface and the optical axis thereof, the X-axis is in the direction of the optical axis, the Y-axis is perpendicular to the X-axis in the main-scanning cross section, and the Z-axis is perpendicular to the X-axis and the Y-axis.

R denotes a radius of curvature on the optical axis in the main-scanning cross section, and k, $B_2$, $B_4$, $B_6$, $B_8$, $B_{10}$, $B_{12}$, $B_{14}$, and $B_{16}$ denote aspherical surface coefficients in the main-scanning cross section. The shape of the optical surface in the main-scanning cross section can be asymmetrical about the optical axis in the main-scanning direction by setting the aspherical surface coefficients $B_2$ to $B_{16}$ to different values for one side and for the other side (positive and negative sides in the Y-axis direction) with respect to the optical axis (X-axis).

For each optical surface of the imaging optical element 5 according to this example, a radius of curvature r' in the sub-scanning cross section (radius of curvature in the sagittal plane) at a position where a light beam reaching an image height in the main-scanning direction intersects with the optical surface is represented by the following Expression.

$$\frac{1}{r'} = \frac{1}{r} + \sum_{i}^{16} E_i Y^i$$

Here, r denotes a radius of curvature on the optical axis in the sub-scanning cross section, and $E_i$ denotes coefficients representing a variation in the sagittal direction. A sagittal shape may be defined as a surface shape in a plane that is perpendicular to the main-scanning cross section and that includes a surface normal to the optical surface at the position where the light beam in the main-scanning cross section reaching an image height in the main-scanning direction intersects with the optical surface.

Figure 4A:
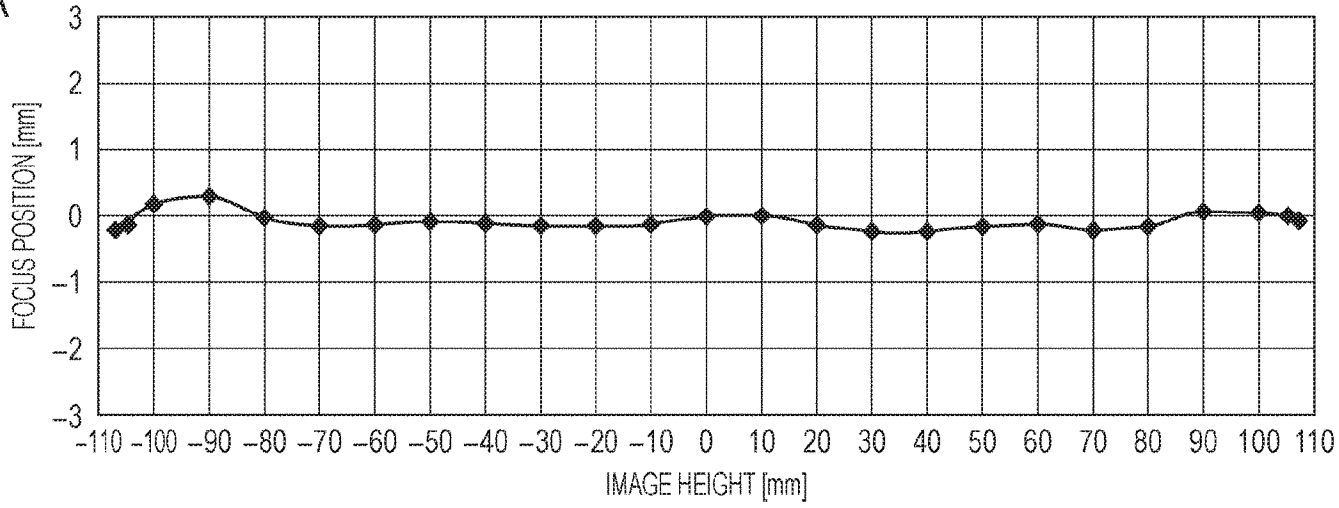
FIGS. 4A and 4B illustrate graphs of aberration characteristics of an optical scanning apparatus according to an example.
Figure 4B:
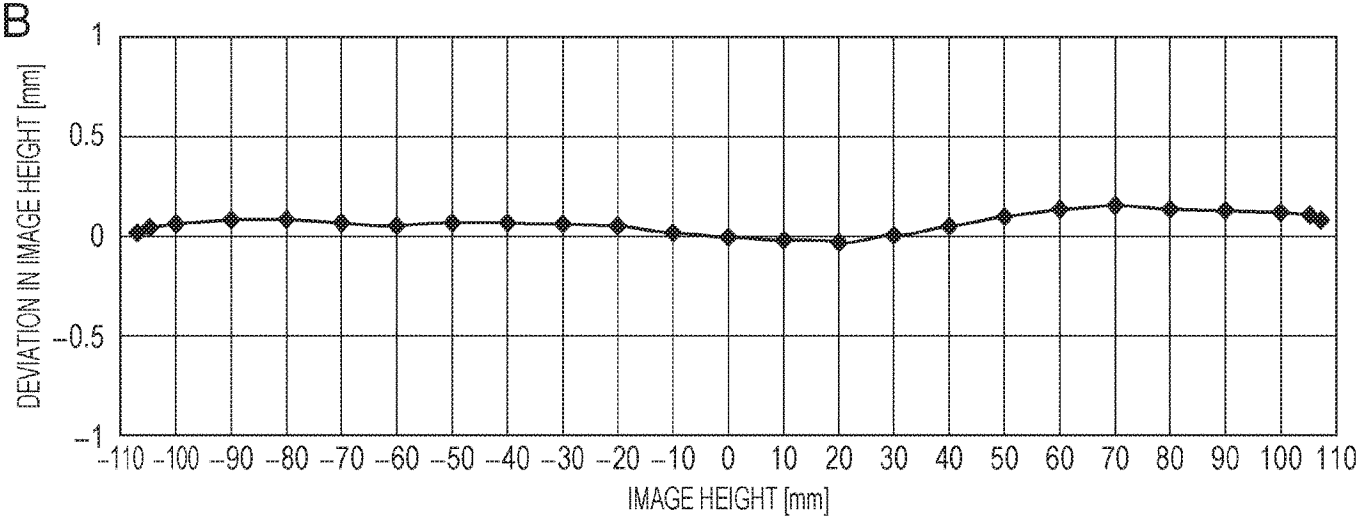

FIGS. 4A and 4B illustrate aberration characteristics of the optical scanning apparatus 100 according to this example. FIG. 4A represents a relation between a focus position and an image height (field curvature) in the main-scanning cross section, and FIG. 4B represents a relation between deviation in image height and the image height (distortion). As illustrated in FIGS. 4A and 4B, both of the aberrations are corrected for appropriately.

Table 3 indicates values of the middle term in each of Expressions (1), (2), (6), (7), and (8) for the optical scanning apparatus 100 according to this example. As illustrated in Table 3, the optical scanning apparatus 100 satisfies all of the Expressions (1, (2), (6), (7), and (8).

TABLE 3

| | Upper | Lower |
|---|---|---|
| Expression (1) | 1.29 | 1.23 |
| Expression (2) | 0.84 | |
| Expression (6) | 0.57 | |
| Expression (7) | 1.04 | |
| Expression (8) | −5.62 | |

Image Forming Apparatus

Figure 5:
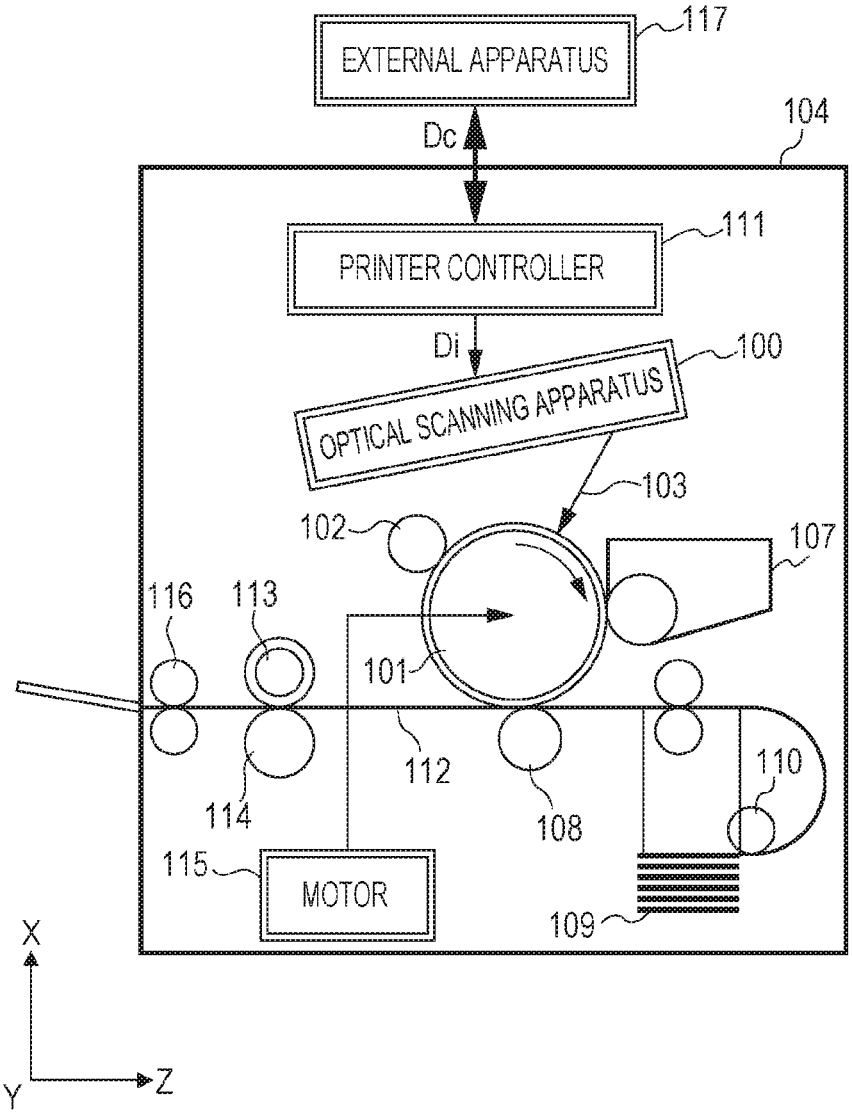
FIG. 5 is a cross-sectional view of a principal portion of an image forming apparatus according to an embodiment.

FIG. 5 is a schematic diagram (cross-sectional view in the sub-scanning cross section) of principal portions of an image forming apparatus 104 according to an embodiment of the present disclosure. The image forming apparatus 104 includes the optical scanning apparatus 100 according to the example described above.

As illustrated in FIG. 5, the image forming apparatus 104 receives code data Dc that is output from an external apparatus 117 such as a personal computer. The code data Dc is converted into an image signal (dot data) Di by a printer controller 111 in the image forming apparatus 104 and output to the optical scanning apparatus 100. A light beam 103 modulated in accordance with the image signal Di is emitted from the optical scanning apparatus 100, and a photosensitive surface (surface to be scanned) of a photosensitive drum 101 is scanned in the main-scanning direction with the light beam 103. The printer controller 111 not only converts the data as described above but also controls various units in the image forming apparatus 104 such as a motor 115, which will be described below. In addition, the printer controller 111 may serve to control light emission from the light source in accordance with deviation in partial magnification of the imaging optical element, and to control light emission from the light source in accordance with an imaging coefficient on the optical axis of the imaging optical element.

The photosensitive drum 101 serving as an electrostatic latent image bearing member (photosensitive member) is rotated clockwise by the driving force of the motor 115. The photosensitive surface of the photosensitive drum 101 moves in the sub-scanning direction relative to the light beam 103 in accordance with this clockwise rotation. A charging roller 102 that uniformly charges the photosensitive surface is disposed above the photosensitive drum 101 so as to be in contact with the photosensitive surface. The photosensitive surface charged by the charging roller 102 is irradiated with the light beam 103 from the optical scanning apparatus 100.

The light beam 103 is modulated in accordance with the image signal Di as described above, and an electrostatic latent image is formed on the photosensitive surface that is irradiated with the light beam 103. This electrostatic latent image is developed as a toner image by a developing device 107, which is disposed on the further downstream side of the irradiation position of the light beam 103 in the rotation direction of the photosensitive drum 101 so as to be in contact with the photosensitive surface.

The toner image developed by the developing device 107 is transferred onto a sheet 112 serving as a recording material by a transfer roller 108 (transferring device) that is disposed under the photosensitive drum 101 so as to face the photosensitive drum 101. The sheet 112 is stored in a sheet cassette 103 in front of the photosensitive drum 101 (on the right side in FIG. 5), but manual sheet feed, may be performed as well. A feed roller 110 is disposed at the edge of the sheet cassette 109, thereby conveying the sheet 112 in the sheet cassette 109 to a conveyance path.

The sheet 112 onto which an unfixed toner image has been transferred is further conveyed to a fixing device behind the photosensitive drum 101 (on the left side in FIG. 5). The fixing device has a fixing roller 113 that includes a fixing heater (not depicted) therein, and a pressure roller 114 disposed so as to press against the fixing roller 113. The fixing device presses the sheet 112 conveyed from the transfer roller 108 at a pressing portion between the fixing roller 113 and the pressure roller 114, while heating, thereby fixing the unfixed toner image on the sheet 112. Further, a discharge roller 116 is disposed behind the fixing roller 113, thereby discharging the sheet 112 on which the toner image has been fixed from the image forming apparatus 104.

The image forming apparatus 104 may include a plurality of sets that each include the optical scanning apparatus 100, the photosensitive drum 101, and the developing device 107 so as to operate as a color image forming apparatus. Further, for example, a color digital copier may be configured by connecting to the image forming apparatus 104 a color image reading apparatus that has a line sensor, such as a charge-coupled device (CCD) sensor or a complementary metal oxide silicon (CMOS) sensor, and serves as the external apparatus 117.

Modifications

While a desirable embodiment and a desirable example of the present disclosure have been described, the present disclosure is not limited to the embodiment and the example, and various combinations, modifications, and variations may be made within the scope of the disclosure.

For example, although the example described above is configured to use a light beam from a single light source to scan a single surface to be scanned, the present disclosure may be applied in other configurations. A configuration in which light beams from a plurality of light sources are deflected by a single deflector simultaneously to scan a plurality of surfaces to be scanned may be adopted.

While the present disclosure has been described with reference to exemplary embodiments, it is to be understood that the disclosure is not limited to the disclosed exemplary embodiments. The scope of the following claims is to be accorded the broadest interpretation so as to encompass all modifications and equivalent structures and functions.

This application claims the benefit of Japanese Patent Application No. 2017-107076 filed May 30, 2017, which is hereby incorporated by reference herein in its entirety.

What is claimed is:

1. An optical scanning apparatus comprising:

a deflector configured to deflect a light beam from a light source and scan a surface to be scanned in a main-scanning direction; and a single imaging optical element configured to guide the light beam deflected by the deflector to the surface to be scanned, wherein scanning speeds of the light beam on the surface to be scanned at an on-axis image height and at an off-axis image height are different from each other, conditions $$1.0<(R1_{\pm h/2}+R2_{\pm h/2})/(R1_{\pm h/2}-R2_{\pm h/2})<1.7 \text{ and}$$

$$0.8<h/TC<2.0$$

are satisfied, where a maximum off-axis image height in the main-scanning direction on the surface to be scanned is represented as Y=±h, a radius of curvature of an entrance surface and a radius of curvature of an exit surface of the imaging optical element in a main-scanning cross section at a position where a principal ray reaching an image height Y=±h/2 passes are denoted by $R1_{\pm h/2}$ and $R2_{\pm h/2}$, respectively, and a distance from the deflector to the surface to be scanned on an optical axis of the imaging optical element is denoted by TC, and wherein a shape of the imaging optical element on the optical axis in the main-scanning cross section is biconvex.

2. The optical scanning apparatus according to claim 1, wherein a condition $$0.3\leq B\leq 0.6$$

is satisfied at the maximum off-axis image height Y=±h, where an imaging coefficient on the optical axis of the imaging optical element is denoted by K and an image height in the main-scanning direction on the surface to be scanned on which the light beam deflected at a scanning angle θ by the deflector is incident is represented as Y=(K/B)×tan(B×θ).

3. The optical scanning apparatus according to claim 1, wherein a condition $$1.0\leq TC/f\leq 1.3$$

is satisfied, a focal length of the imaging optical element on the optical axis in the main-scanning cross section is denoted by f.

4. The optical scanning apparatus according to claim 1, wherein a condition $$3.0<|\beta_s|<6.0$$

is satisfied, where a lateral magnification of the imaging optical element in a sub-scanning cross section is denoted by $\beta_s$.

5. The optical scanning apparatus according to claim 1, further comprising:

a controller configured to control light emission from the light source in accordance with deviation in partial magnification of the imaging optical element.

6. The optical scanning apparatus according to claim 5, wherein the controller controls light emission from the light source in such a way that the deviation in partial magnification of the imaging optical element is less than or equal to 2% at all image heights.

7. The optical scanning apparatus according to claim 1, further comprising:

a controller configured to control light emission from the light source in accordance with $1/\cos^2(B\times\theta)$, where an imaging coefficient on the optical axis of the imaging optical element is denoted by K and an image height in the main-scanning direction on the surface to be scanned on which a light beam deflected at a scanning angle θ by the deflector is incident is represented as Y=(K/B)×tan(B×θ).

8. The optical scanning apparatus according to claim 7, wherein the controller controls light emission from the light source in such a way that the deviation in partial magnification of the imaging optical element is less than or equal to 2% at all image heights.

9. An image forming apparatus comprising:

an optical scanning apparatus;

a developing device configured to develop as a toner image an electrostatic latent image formed by the optical scanning apparatus on a surface to be scanned;

a transferring device configured to transfer onto a recording material the toner image that has been developed; and a fixing device configured to fix on the recording material the toner image that has been transferred, wherein the optical scanning apparatus includes a deflector configured to deflect a light beam from a light source and scan a surface to be scanned in a main-scanning direction, and a single imaging optical element configured to guide the light beam deflected by the deflector to the surface to be scanned, wherein scanning speeds of the light beam on the surface to be scanned at an on-axis image height and at an off-axis image height are different from each other, conditions $$1.0<(R1_{\pm h/2}+R2_{\pm h/2})/(R1_{\pm h/2}-R2_{\pm h/2})<1.7 \text{ and}$$

$$0.8<h/TC<2.0$$

are satisfied, where a maximum off-axis image height in the main-scanning direction on the surface to be scanned is represented as Y±=h, a radius of curvature of an entrance surface and a radius of curvature of an exit surface of the imaging optical element in a main-scanning cross section at a position where a principal ray reaching an image height Y and a distance from the deflector to the surface to be scanned on an optical axis of the imaging optical element is denoted by TC, and wherein a shape of the imaging optical element on the optical axis in the main-scanning cross section is biconvex.

10. An image forming apparatus comprising:

an optical scanning apparatus; and a printer controller configured to convert data that is output from an external apparatus to an image signal and output the image signal to the optical scanning apparatus, wherein the optical scanning apparatus includes a deflector configured to deflect a light beam from a light source and scan a surface to be scanned in a main-scanning direction, and a single imaging optical element configured to guide the light beam deflected by the deflector to the surface to be scanned, wherein scanning speeds of the light beam on the surface to be scanned at an on-axis image height and at an off-axis image height are different from each other, conditions $$1.0<(R1_{\pm h/2}+R2_{\pm h/2})/(R1_{\pm h/2}-R2_{\pm h/2})<1.7 \text{ and}$$

$$0.8<h/TC<2.0$$

are satisfied, where a maximum off-axis image height in the main-scanning direction on the surface to be scanned is represented as Y=±h, a radius of curvature of an entrance surface and a radius of curvature of an exit, surface of the imaging optical element in a main-scanning cross section at a position where a principal ray reaching an image height Y=±h/2 passes are denoted by $R1_{\pm h/2}$ and $R2_{\pm h/2}$, respectively, and a distance from the deflector to the surface to be scanned on an optical axis of the imaging optical element is denoted by TC, and wherein a shape of the imaging optical element on the optical axis in the main-scanning cross section is biconvex.

* * * * *